US009476238B2

(12) United States Patent
Mooers

(10) Patent No.: US 9,476,238 B2
(45) Date of Patent: Oct. 25, 2016

(54) HINGE PROVIDING AN OPENING OR CLOSING FORCE

(71) Applicant: William Scott Mooers, Sanford, FL (US)

(72) Inventor: William Scott Mooers, Sanford, FL (US)

( * ) Notice: Subject to any disclaimer, the term of this patent is extended or adjusted under 35 U.S.C. 154(b) by 0 days.

(21) Appl. No.: 14/564,584

(22) Filed: Dec. 9, 2014

(65) Prior Publication Data

US 2016/0090768 A1 Mar. 31, 2016

Related U.S. Application Data

(60) Provisional application No. 62/055,150, filed on Sep. 25, 2014.

(51) Int. Cl.

| | |
|---|---|
| ***E05F 1/08*** | (2006.01) |
| ***E05F 1/12*** | (2006.01) |
| ***E05D 11/00*** | (2006.01) |
| ***E05D 3/02*** | (2006.01) |

(52) U.S. Cl.
CPC . *E05F 1/12* (2013.01); *E05D 3/02* (2013.01); *E05D 11/0054* (2013.01)

(58) Field of Classification Search
CPC ..... Y10T 16/5383; Y10T 16/2771; Y10T 16/2799; Y10T 16/282; Y10T 16/304; Y10T 16/568; Y10T 16/53225; Y10T 16/53235; Y10T 16/53253; E05D 7/0415; E05D 7/0423; E05D 11/105; E05D 11/1064; E05D 11/06; E05D 1/12; E05D 1/1253; E05D 1/1261; E05D 1/1284; E05D 1/1215; E05D 1/10; E05D 1/14; E05D 1/1041; E05D 1/1083; E05F 3/00; E05F 3/20; E05F 5/02; E05Y 2201/21; E05Y 2900/20
See application file for complete search history.

(56) References Cited

U.S. PATENT DOCUMENTS

| | | | | |
|---|---|---|---|---|
| 90,686 A | | 6/1869 | Freston | |
| 50,086 A | | 6/1893 | Van Wagoner | |
| 842,121 A | * | 1/1907 | Smith | E05F 1/1008 16/63 |
| 1,343,033 A | * | 6/1920 | Campbell | E05F 1/105 16/78 |
| 1,380,312 A | * | 5/1921 | Bellican | E05F 1/1066 16/286 |

(Continued)

FOREIGN PATENT DOCUMENTS

CN 201310089341 3/2013

*Primary Examiner* — Chuck Mah
(74) *Attorney, Agent, or Firm* — Ferdinand M. Romano; Beusse Wolter Sanks & Maire, PLLC.

(57) ABSTRACT

A hinge with first and second leaves. Bearing sleeves are attached along an edge of the first leaf and a bearing sleeve is attached along an edge of the second leaf. A hinge pintle is sized to extend into each of the apertures for mating engagement with the bearing sleeves and connect the hinge leaves for rotation. With an elastomeric member fastened between the first hinge leaf and a cover plate, and between the second hinge leaf and another cover plate, as one leaf is rotated, the member stretches and provides a force to urge the leaf to rotate.

20 Claims, 9 Drawing Sheets

(56) References Cited

U.S. PATENT DOCUMENTS 1,418,919 A * 6/1922 Hall ..... E05F 1/1269 16/286
1,481,742 A * 1/1924 Riley ..... E05C 17/203 16/374
1,504,748 A * 8/1924 Dorl ..... E05F 1/105 16/78
1,646,580 A * 10/1927 Eastman ..... E05C 17/203 16/82
1,688,930 A * 10/1928 Hyland ..... E05D 3/02 16/226
1,730,948 A * 10/1929 Rosenthal ..... E05F 1/105 126/194
1,775,789 A * 9/1930 Taffe ..... E05C 17/32 16/322
1,819,212 A * 8/1931 Toncray ..... E05C 17/36 16/82
1,837,517 A * 12/1931 Ball ..... E05C 17/36 16/82
1,903,923 A * 4/1933 Hyde ..... E05F 1/1041 16/50
1,965,133 A 7/1934 Bambino
2,290,219 A * 7/1942 Ulfving ..... E05F 1/1246 16/291
2,331,512 A 10/1943 Siedschlag
2,394,878 A * 2/1946 Slopa ..... E05F 5/027 292/79
2,507,965 A 5/1950 Eichner
2,550,626 A * 4/1951 Vollmer ..... E05C 17/24 16/82
2,568,225 A * 9/1951 Doman ..... E05F 1/1041 16/292
2,607,411 A 8/1952 Van Vliet
2,691,187 A 10/1954 Lorenz
2,705,337 A * 4/1955 Langdon ..... E05F 1/10 16/66
2,795,272 A 5/1957 McBerty
2,804,137 A 8/1957 Couse
2,994,371 A 8/1961 Morseth
2,998,618 A * 9/1961 Roy ..... E05F 1/1284 16/293
3,588,946 A * 6/1971 MacDonald ..... E05F 1/1253 16/224
3,827,105 A * 8/1974 Branchaud ..... E05F 1/1246 16/286
4,393,541 A * 7/1983 Hujsak ..... B25J 17/0241 16/291
4,875,252 A * 10/1989 Falconer ..... E05D 3/186 16/288
4,991,256 A * 2/1991 Jeynes ..... E05F 1/105 16/61
5,009,495 A * 4/1991 Williams ..... G02C 5/008 16/228
5,016,317 A * 5/1991 Hung ..... E05F 3/108 16/54
5,715,573 A * 2/1998 Holemans ..... B64G 1/222 16/287
5,779,194 A * 7/1998 Doll ..... B64G 1/645 16/286
6,311,367 B1 * 11/2001 Larsen ..... E05F 3/221 16/375
6,460,221 B1 10/2002 Eromaki
6,682,020 B2 * 1/2004 Janson ..... B64G 1/222 244/172.6
7,004,349 B2 2/2006 Heiberg
7,100,241 B2 * 9/2006 Zetti ..... E05D 3/16 16/283
7,753,058 B2 7/2010 Chudzik
8,201,576 B2 6/2012 Klein
8,549,711 B2 * 10/2013 Apostoloff ..... E05D 11/06 16/319
8,966,713 B1 * 3/2015 Russo ..... E05F 1/10 16/285
2002/0046443 A1 * 4/2002 Maruyama ..... E05D 1/02 16/277
2003/0233731 A1 12/2003 Cotton
2004/0016714 A1 1/2004 Wood
2004/0134029 A1 * 7/2004 Horn ..... E05D 1/04 16/280
2006/0089182 A1 4/2006 Garrrell
2006/0143868 A1 * 7/2006 Bauer ..... B60N 3/023 16/438
2007/0145871 A1 * 6/2007 Christie ..... E05D 3/022 312/329
2010/0088850 A1 4/2010 Dringenberg
2012/0174339 A1 7/2012 Novin
2013/0305488 A1 * 11/2013 Dodge ..... E05D 7/0423 16/245
2014/0215759 A1 * 8/2014 Mitchell ..... E05D 11/0054 16/235
2015/0074944 A1 3/2015 Tung

* cited by examiner

HINGE PROVIDING AN OPENING OR CLOSING FORCE

PRIORITY BASED ON RELATED APPLICATION

This application claims priority based on U.S. Provisional Application No. 62/055,150 filed Sep. 25, 2014.

FIELD OF THE INVENTION

This invention relates generally to hinges and, more specifically, to hinges having mechanisms providing for closure or opening of panels including doors and gates.

BACKGROUND OF THE INVENTION

Many indoor and outdoor hinge designs are of the type which develop forces to urge movement of a door or other type of panel from an open position to a closed position or from a closed position to an open position. Hinges of this type are sometimes required to assure safety. For example, fenced areas which include swimming pools often have access gates that close automatically and latch the gate in a manner which prevents children from gaining access. The closing force is often created with a spring that develops potential energy when the hinge and gate are moved from the closed position to the open position. After a person opens the gate, passes through the gate and lets go of the gate, the spring forces closure of the gate.

It is desirable that hinges which provide such closure forces be able to operate a very large number of cycles without fatigue. It is also desirable that the hinges withstand a variety of environmental conditions, including operation in a corrosive environment and exposure to outdoor conditions. The conditions vary significantly depending on season, geographic location and proximity to salt water. Efforts to render conventional hinge designs more tolerant to harsh indoor or outdoor environments can escalate cost of the components. Further, repair and periodic maintenance, such as required to comply with safety codes, can add significant cost during the life of such hinges. To assure reliability of performance, especially in a safety application, a low cost hinge design is needed which requires relatively little maintenance and provides reliable performance and long lasting cosmetic appearance.

SUMMARY OF THE INVENTION

According to a first series of embodiments of the invention a hinge is provided for supporting a gate or door along a fence or wall. The hinge includes first and second hinge leaves. One of the leaves includes fastening apertures for attachment along a surface of a gate or door, and the other of the leaves has fastening apertures for attachment along a fence, post or wall surface. The hinge further includes first and second bearing sleeves attached along an edge of the first leaf in spaced-apart relation to one another while a third bearing sleeve is attached along an edge of the second leaf so that, when the edge of the second leaf is positioned along the edge of the first leaf, the third bearing sleeve can be positioned between the first and second bearing sleeves. The first and second bearing sleeves each include an aperture that can be aligned with the aperture of the third bearing sleeve when the third bearing sleeve is positioned between the first and second bearing sleeves. A hinge pintle sized to extend into each of the apertures for mating engagement with the first, second and third bearing sleeves and connect the first and second hinge leaves to one another for rotation of one of the leaves about the hinge pintle and to support a hinge load. A first cover plate has fastening apertures for attachment to the first leaf and a second cover plate has fastening apertures for attachment to the second leaf. The hinge also includes an elastomeric member which, when stretched beyond a first length, develops a force urging the member to resume the first length so that, with the member fastened between the first hinge leaf and the first of the cover plates, and between the second hinge leaf and the second of the cover plates: as one leaf is rotated in a first direction of rotation about the hinge pintle, the member stretches and provides a force to urge the leaf to rotate in a direction of rotation opposite the first direction of rotation.

In the first series of embodiments, the elastomeric member may be an elongate body having a relatively large length to width ratio, with a length extending between first and second end portions of the elastomeric member and from the first hinge leaf to the second hinge leaf, so that when one of the hinge leaves is rotated with respect to the other hinge leaf to increase tension in the elastomeric member, the length of the elastomeric member increases.

According to a second series of embodiments of the invention, a method is provided for forming a hinge. The method includes forming a channel between at least one first hinge leaf and one cover plate into which the elastomeric member fits. The channel allows for movement of the elastomeric member when sandwiched between the at least one hinge leaf and one cover plate. This method may further include forming the channel of sufficient size, e.g., depth, that portions of the channel adjoining the bearing sleeve 38 allow for movement of the elastomeric member as tension diminishes without binding of the elastomeric member.

A method is also provided for adjusting a hinge force. In one embodiment, each of two opposing end portions of an elastomeric member is affixed to one of two hinge plates in a pair so that, when one of the hinge plates is rotated with respect to the other hinge plate, tension in the elastomeric member changes. One of the two opposing end portions of the elastomeric member is displaced relative to the hinge plate to which it is attached to modify the amount of tension present in the elastomeric member when said one of the hinge plates is rotated with respect to the other hinge plate.

Also according to the invention, a module is provided for adjusting tension in an elastomeric member used to provide a force in a hinge. With the hinge comprising a pair of hinge plates, the module includes a bar having first and second opposing ends. The bar has a pair of spaced apart slots formed therein. Each slot is coupled to a component on one of the hinge plates to permit movement of the bar with respect to said one of the hinge plates. The bar may have movement along a path constrained by the bar slots. The bar may include an attachment component to secure an end portion of the elastomeric member to the bar. The module may further include a threaded member rotationally coupled to apply a force to displace the bar relative to said one of the hinge plates and thereby create or remove tension in the elastomeric member. Such tension is separate from tension created or removed by rotation of one hinge plate relative to the other hinge plate.

According to another series of embodiments of the invention a module is provided for adjusting tension in an elastomeric member that provides a force to urge movement in a hinge of the type comprising a pair of hinge plates. With the elastomeric member having first and second opposing end portions the module includes a bar having a pair of spaced apart slots each formed in one of two first and second opposing ends of the bar. Each slot is coupled to a first component on one of the hinge plates to permit movement of the bar with respect to said one of the hinge plates. The bar includes a second component configured to secure one of the end portions of the elastomeric member to the bar.

According to still another series of embodiments, a mechanism is provided to adjust the force applied by an elastomeric member to a movable hinge section. An adjustment rod includes a first surface along which a first threaded pattern is formed, and a tension adjustment body includes a second surface along which a second threaded pattern is formed. The first and second surfaces are complementary in the sense that one surface fits within the other surface. Also, the first and second threaded patterns are complementary to one another so that each thread pattern will matingly engage the other, causing the adjustment rod to be displaced along a first direction as the first surface and the first threaded pattern are rotated with respect to the second surface and the second threaded pattern. With the elastomeric member having first and second opposing end portions, and a hinge comprising first and second hinge sections connectable to one another for rotation about an axis: (i) the first hinge section includes a first component to restrict movement of the first end portion with respect to the first hinge section when the elastomeric member is tensioned, and (ii) the second hinge section includes one or more second components to restrict movement of the tension adjustment body along the first direction relative to the second hinge section. A stop is positioned to receive a force by a rotation of the adjustment rod which displaces the first surface with respect to the second surface. The tension adjustment body includes a third component to secure the second end portion of the elastomeric member and restrict movement of the second end portion relative to the tension adjustment body so that, with the hinge sections connected to one another and the elastomeric member tensioned:

(i) when one of the hinge sections is rotated with respect to the other hinge section, tension of the elastomeric member changes, and (ii) when movement of the first end portion and the second end portion of the elastomeric member is restricted, tension in the elastomeric member is adjusted by a rotation of the adjustment rod with respect to the aperture.

In one exemplary embodiment of the mechanism, the first surface of the adjustment rod is an exterior portion of the rod with the threaded pattern formed along the exterior portion, and the second surface of the tension adjustment body defines an aperture into which the exterior portion of the rod fits, with the second threaded pattern extending along the aperture to matingly engage the first threaded pattern as the rod portion is rotated and inserted within the aperture. For example, the tension adjustment body may comprise a nut along which the second surface defines an aperture into which the exterior portion of the rod fits, with the second threaded pattern formed along the aperture to engage the first threaded pattern.

BRIEF DESCRIPTION OF THE FIGURES

Features, aspects, and advantages of the present invention will become better understood when the following detailed description is read with reference to the accompanying drawings in which like characters represent like parts throughout, and wherein.

DETAILED DESCRIPTION OF THE INVENTION

Before describing in detail the particular methods and features relating to the invention, it should be observed that the present invention resides primarily in a novel and non-obvious combination of elements and method steps. So as not to obscure the disclosure with details that will be readily apparent to those skilled in the art, certain conventional elements and steps may be presented with lesser detail, while the drawings and the specification describe in greater detail other elements and steps more pertinent to understanding the invention. The described embodiments are not intended to define limits as to the structure or method of the invention, but only to provide exemplary constructions. The embodiments are permissive rather than mandatory and are illustrative rather than exhaustive.

Figure 1A:
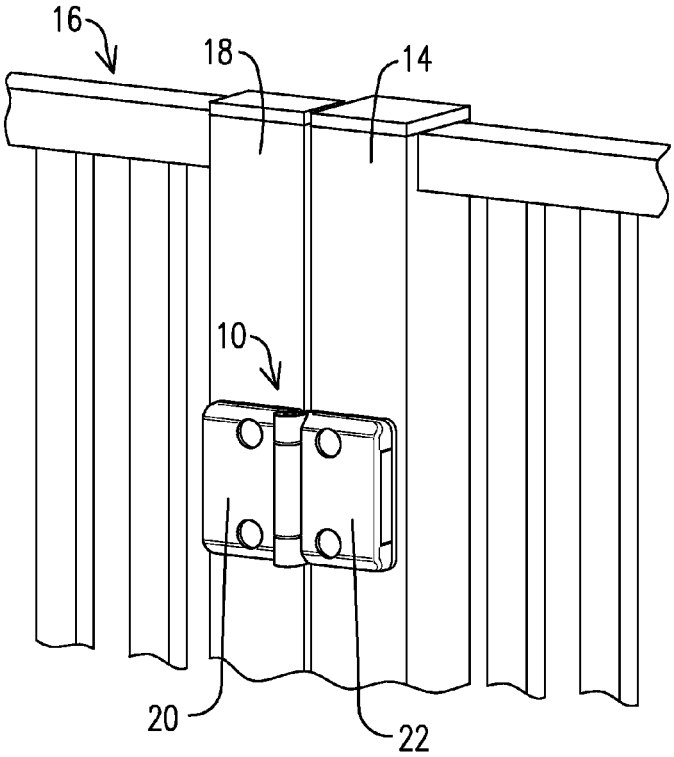
FIG. 1A is a front perspective view of a hinge, according to an embodiment of the invention, installed for operation of a gate.
Figure 1B:
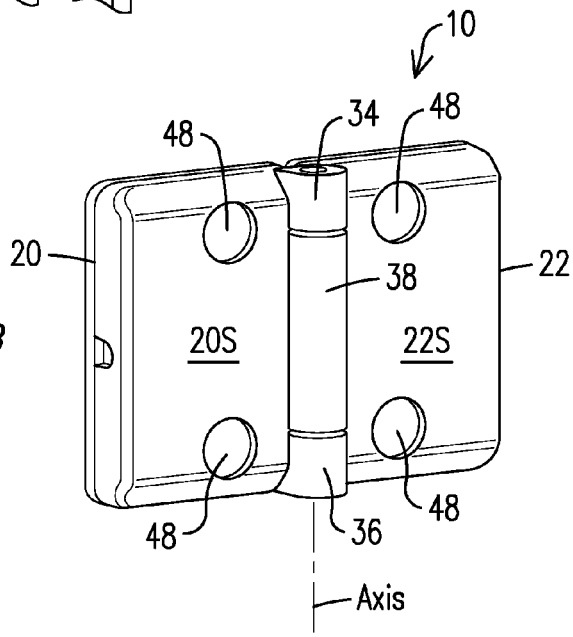
FIG. 1B is an enlarged front perspective view of the hinge shown in FIG. 1A.
Figure 1C:
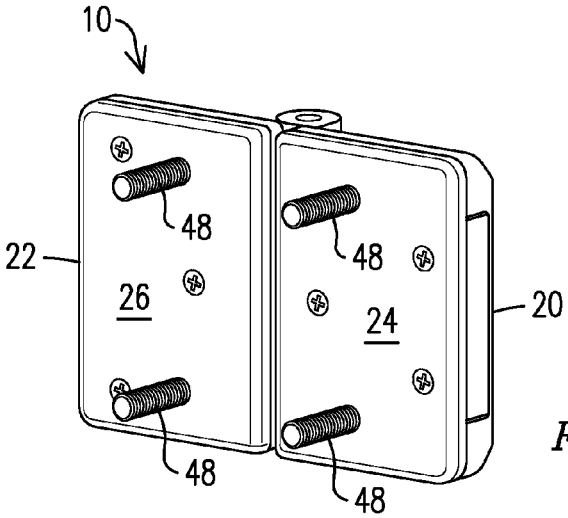
FIG. 1C is a rear perspective view of the hinge shown in FIG. 1A illustrating exterior rear side cover plates attached to the hinge leaves.

With reference to the figures generally, there is illustrated a hinge 10 according to an embodiment of the invention. The hinge is suitable for both indoor and outdoor uses to provide for closure of doors, gates and other types of panels. In the perspective view of FIG. 1A, the hinge 10 is shown mounted along a surface of a fence post 14 to support a gate 16 and effect closure of the gate. The post 14 may be mounted in the ground in a conventional manner. For purposes of illustrating the hinge 10, FIG. 1A provides a partial view of the post 14 and a partial view of the gate 16, showing only one frame member 18 of the gate with the hinge 10 mounted along a surface of the frame member 18. The post 14 may be part of a supporting structure for a fence or a wall. The frame member 18 may, as shown in FIG. 1, be one of several components in a gate panel which is attached to a frame member (not shown) of the gate 16. The hinge 10 may be mounted through the frame member 18 to the gate frame member for secure attachment of the hinge to the gate 16. More generally, the hinge 10 may be mounted on a door or a gate and to or along any type of panel, post, beam or wall surface to support the gate or door. Although not shown in the figures, with the post 14 secured in the ground, the gate 16 may receive support from the post 14 with multiple hinges 10 attached to both the gate and the post at different heights above the ground.

The hinge 10 includes a pair of hinge leaves 20, 22 and a pair of rear cover plates 24, 26, each having an exemplary rectangular shape and a tension adjustment module 28 positioned between the hinge leaf 20 and the cover plate 24. The hinge leaves and the cover plates are further shown in FIGS. 1B and 1C. The hinge leaves, the cover plates and the module 28 are also illustrated in the exploded views of FIGS. 2A and 2B. The hinge leaf 20 has an exposed outside surface 20*s* facing away from the mounting surface of the gate 16, and the hinge leaf 22 has an exposed outside surface 22*s* facing away from the mounting surface of the post 14. The cover plates are shown in the rear perspective view of the hinge 10 in FIG. 1C as well as in the rear perspective exploded view of the hinge shown in FIG. 2B.

Figure 6A:
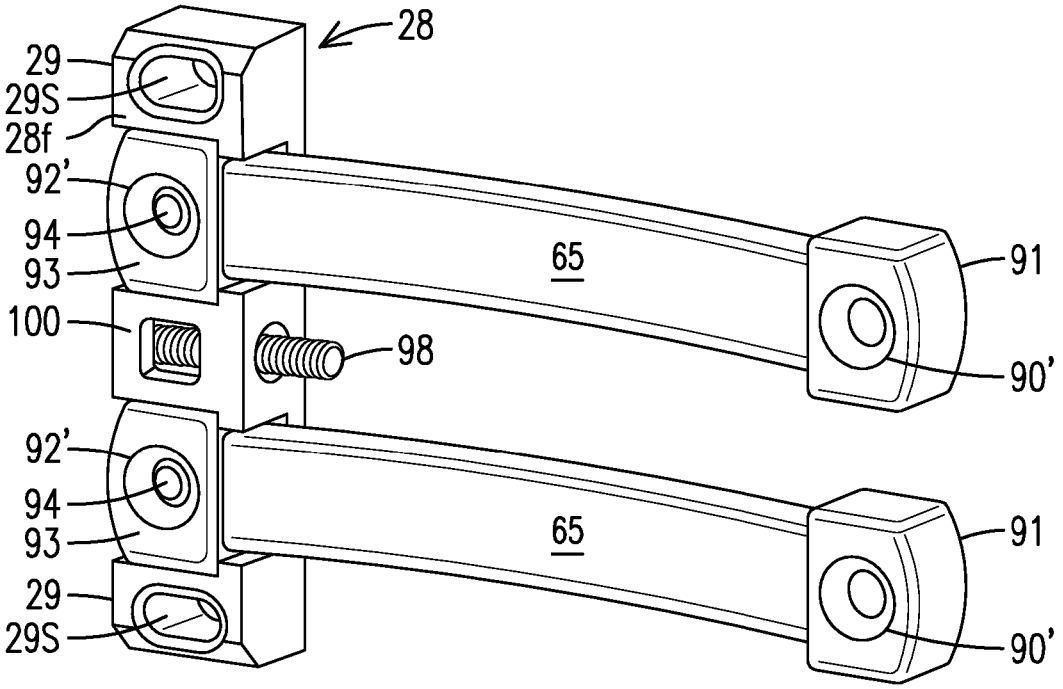
FIG. 6A is a front perspective view of a tension adjustment module having two elastomeric members mounted thereto.
Figure 6B:
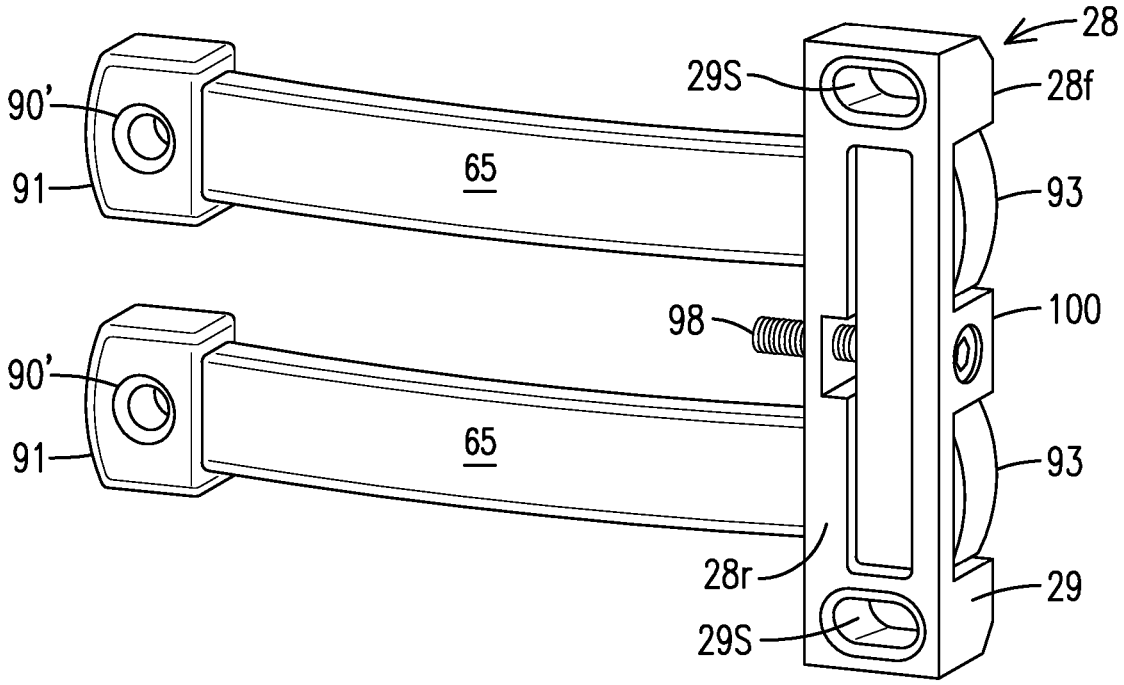
FIG. 6B is a rear perspective view of the tension adjustment module and elastomeric members shown in FIG. 6A.

Also, with reference to FIGS. 6A and 6B, the tension adjustment module 28 is in the shape of a bar having front and rear opposing sides 28*f* and 28*r* and first and second opposing ends in the form of two spaced-apart flanges 29 formed along the major axis of the module. The flanges extend outward from the front side 28*f*. Each flange 29 includes a horizontal slot 29*s*, also referred to as a bar slot. When the hinge is installed on the fence post 14, above the horizontal ground plane, the bar slots 29*s* each extend in a direction parallel to the horizontal ground plane over which the gate 16 and post 14 are installed. When the tension adjustment module 28 is installed between the leaf 20 and the cover plate 24, components, such as spaced-apart bosses, formed on an inside major surface of the hinge leaf 20, are positioned within the slots. This arrangement effects mounting of the module 28 to the hinge 10 while permitting movement of the module 28 along the direction of the slots 29*s* to effect tension adjustment of the hinge 10.

Figure 2A:
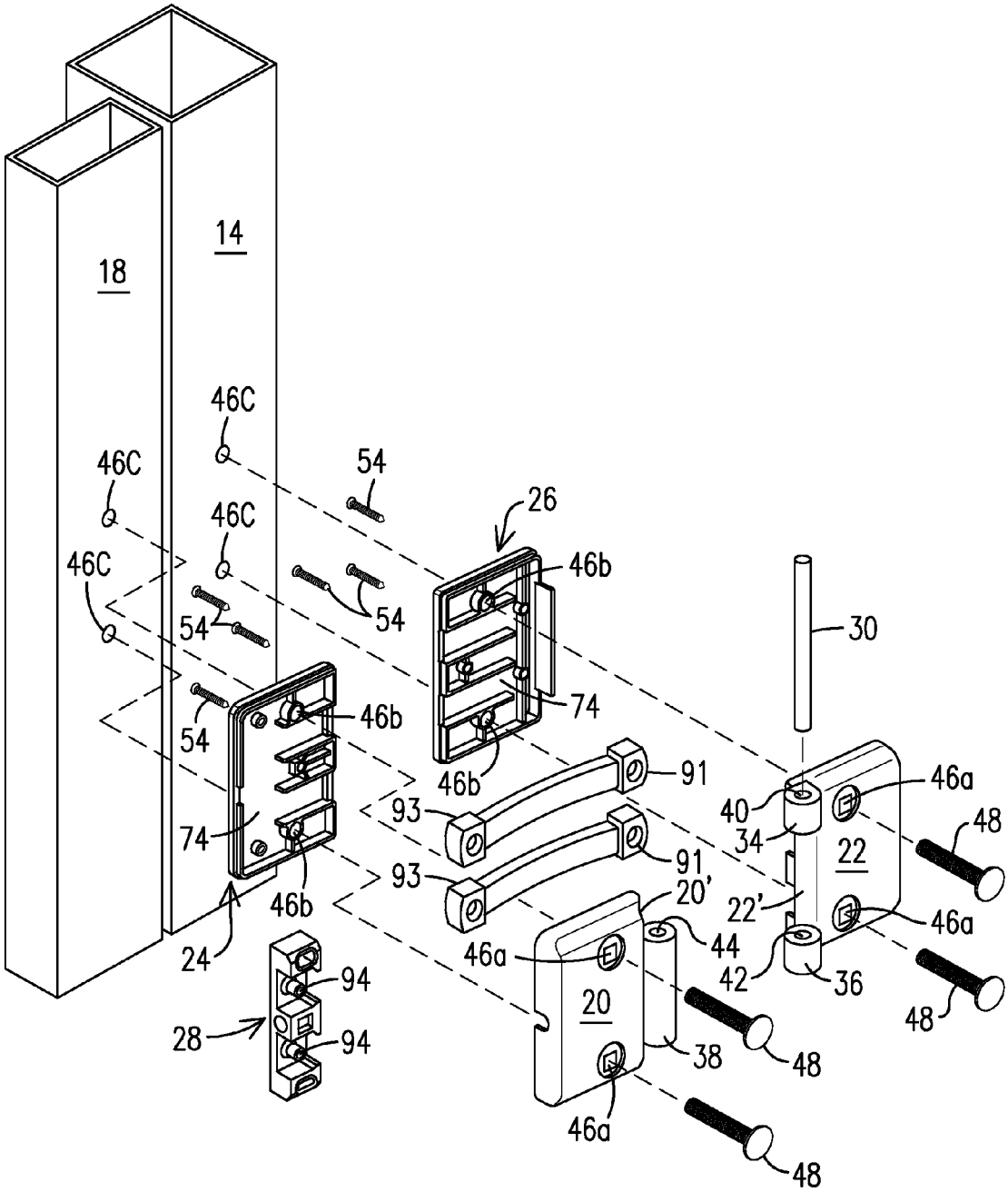
FIG. 2A is an exploded front perspective view of the installed hinge shown in FIG. 1A illustrating elastomeric bands and other components thereof.

With further reference to FIG. 2A, the rear cover plate 24 is attachable with threaded fasteners to the hinge leaf 20 and the rear cover plate 26 is attachable with threaded fasteners to the hinge leaf 22. The combination of the two hinge leaves and the two cover plates contains one or more elastomeric members, e.g., 62, 64, which develop an opposing spring-like force as a gate or door is being opened in order to return the gate or door to a closed position.

For purposes of illustrating one exemplary embodiment, the hinge leaf 20 and cover plate 24 are attached to the gate 16, and the hinge leaf 22 and cover plate 26 are attached to the fence post 14. However, the leaf and plate pair 20, 24 are also attachable to the post while the leaf and plate pair 22, 26 are attachable to the gate. With the hinge leaves having the exemplary illustrated rectangular shape, the leaf 20 includes a first inner edge 20', and the leaf 22 includes a second inner edge 22' along which a pintle 30 can be inserted to connect the leaves for rotation of one or both leaves about an Axis co-aligned with the installed pintle. See FIGS. 2 and 3. To mount the pintle 30, the leaf 22 includes a pair of spaced-apart bearing sleeves 34, 36 integrally formed with the leaf 22, or otherwise attached to the leaf along the second inner edge 22'. Similarly, the leaf 20 includes a third bearing sleeve 38 integrally formed with the leaf or otherwise attached to the leaf 22 along the first inner edge 22'. The third sleeve 38 is positioned between the first and second bearing sleeves 34, 36 when the pintle 30 connects the leaves 20, 22 to one another. The bearing sleeves 34, 36 include co-aligned apertures 40, 42. The third bearing sleeve 38 includes an aperture 44 extending there through. When the third bearing sleeve 38 is positioned between the bearing sleeves 34 and 36, the aperture 44 can also be aligned with the apertures 40, 42. With the leaf 22 positioned to co-align all three apertures 40, 42 and 44, the pintle 30 may be passed through the three apertures to join the leaves 20, 22 in a configuration rotatable about the Axis.

Each combination of a leaf and a cover plate is attachable as an assembled pair (i.e., 20, 24 and 22, 26) to a mounting surface, e.g., on the fence post 14 or on the gate 16. To this end, each leaf and plate in a pair includes a series of co-aligned fastening apertures. The leaf includes fastening apertures 46*a* and the cover plate includes fastening apertures 46*b*, each suitable to receive screw fasteners 48 which each extend there through and into an aperture 46*c* in a suitable mounting surface along the gate 16 or fence post 14. In applications generally, the fasteners 48 may affix the pairs 20, 24 and 22, 26 of leaves and plates along a fence, post or wall surface or along a gate or door surface.

Figure 2B:
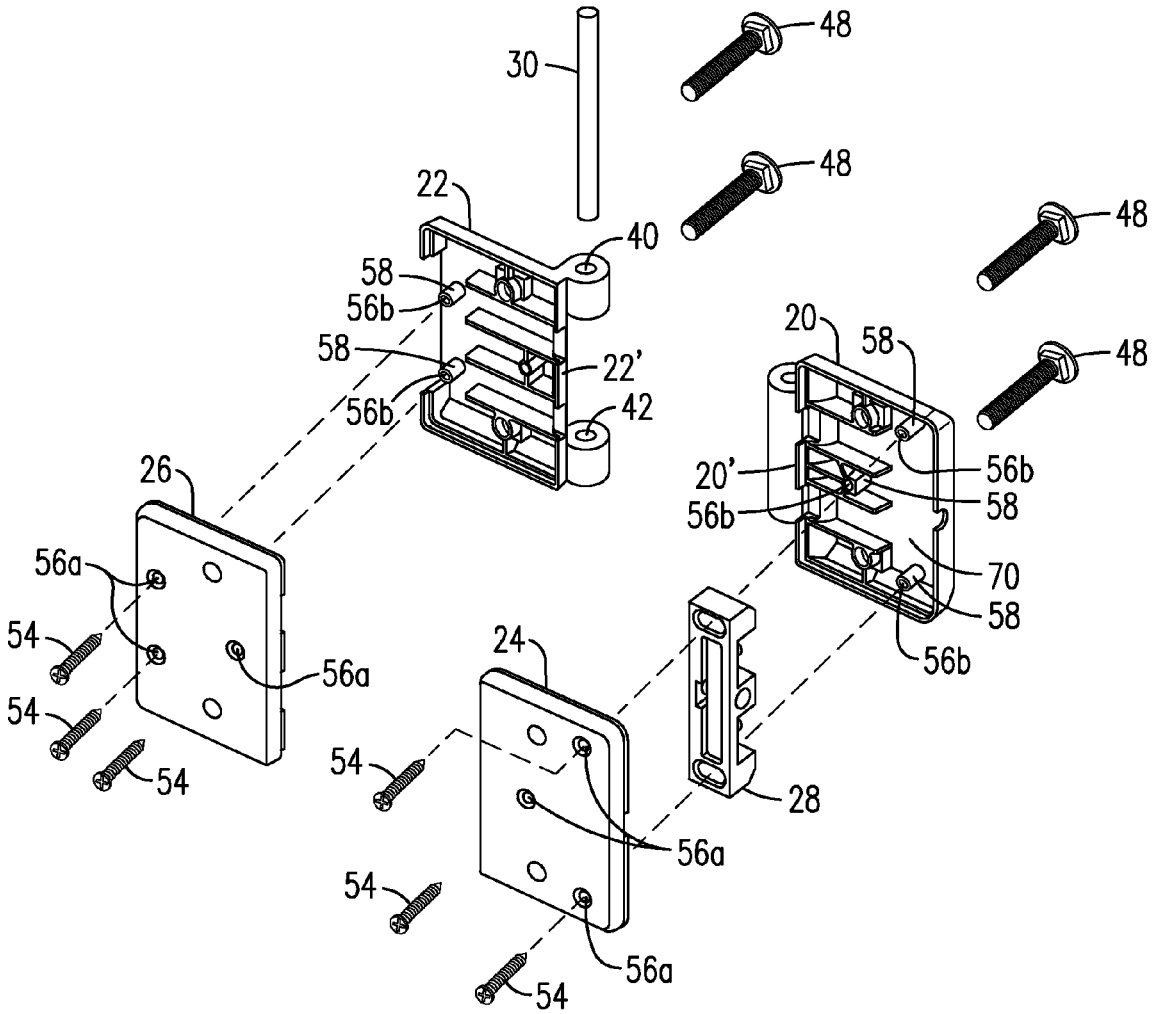
FIG. 2B is an exploded rear perspective view of the installed hinge shown in FIG. 1.

Separate and independent from the attachment of the assembled hinge 10 to a mounting surface, the members in each leaf and cover plate pair can first be attached to one another (e.g., during assembly) with fasteners 54 that press edges of the paired leaves and cover plates against one another. This also secures the tension adjustment module 28 and one or more elastomeric members within the body of the hinge 10. FIG. 2B illustrates each cover plate as including a series of fastening apertures 56*a* and each leaf including a series of fastening apertures 56*b*.

When the members in each leaf and cover plate pair are brought together for attachment to one another, pairs of apertures 56*a*, 56*b* on each mating cover plate and leaf are co-aligned for receipt of a fastener 54. By way of illustration, the fasteners 54 may have threaded ends, each first passing through an aperture 56*a* formed in a cover plate and then matingly engaging matching threads formed in an aperture 56*b* which is formed in a boss $\mathbf{58}_i$. See FIG. 3A which identifies three bosses $\mathbf{58}_1$, $\mathbf{58}_2$, and $\mathbf{58}_3$ on each leaf, each formed on an inside surface 70 about an aperture 56*b*. See, also, FIG. 3B which identifies three bosses $\mathbf{58}_4$, $\mathbf{58}_5$, and $\mathbf{58}_6$ on each cover plate 24, 26, each formed on an inside surface 74 about an aperture 56*a*.

The exemplary apertures 56*b* are blind holes which extend into the leaves 20, 22. The apertures 56*b* may be threaded prior to receiving the fasteners, or the fasteners 54 may be self-tapping screws. When the leaves 20, 22 are formed of plastic (e.g., in an injection molding process) self-tapping metal or plastic screws may be used to engage plastic along walls of the apertures 56*b* in the bosses $\mathbf{58}_i$. Fasteners 54 attach the hinge leaf 22 directly to the associated cover plate 26 with one or more elastomeric members positioned between the leaf 22 and cover plate 26, and without imposition of any other discrete components between the leaf and cover plate. The hinge leaf 20 is attached to the associated cover plate 24 with fasteners 54, but with the tension adjustment module 28 positioned between the leaf 20 and cover plate 24 and, as to be described herein, with the one or more elastomeric members attached to the tension adjustment module 28 to vary the closing force developed on each elastomeric member.

Movement of the hinge through an angle, A, about both the Axis and the pintle 30 is illustrated in FIG. 4. In this exemplary embodiment each leaf surface 20*s*, 22*s* is formed in a plane passing through the Axis. The angle A is measured between these two leaf surfaces. When the hinge 10 is mounted with the fasteners 48 to support a gate 16 and the gate is closed, the hinge angle, A, is extended to a maximum position, which, may be about 180° as shown in FIG. 1. In other applications, the hinge angle A may extend to a value greater or less than about 180° when the gate is closed.

Figure 4A:
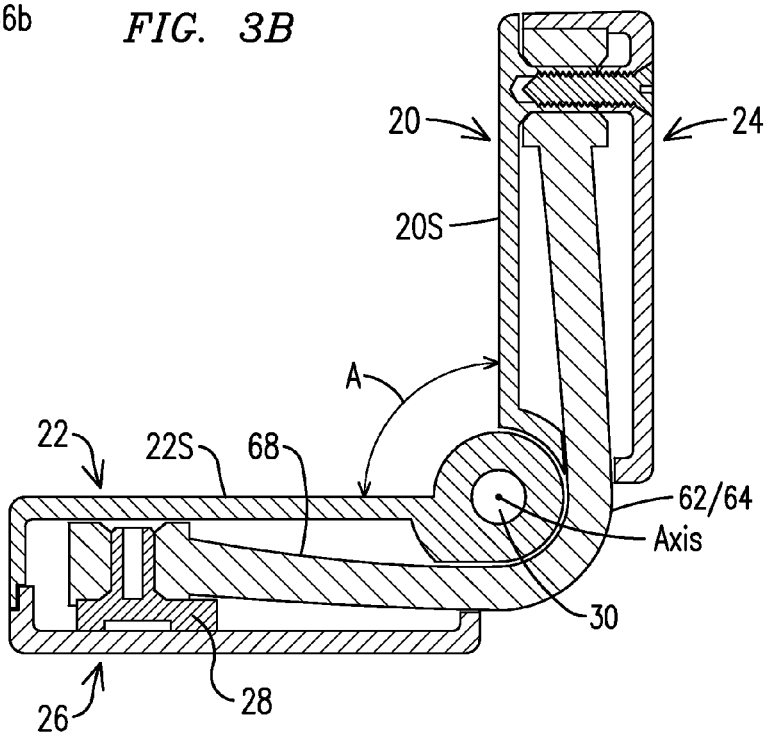
FIG. 4A is a sectional view of the hinge of FIG. 1 taken through an Axis and along one elastomeric member to provide a side view of the elastomeric member while the hinge is in a gate open position, i.e., at a hinge angle of 90°.
Figure 4B:
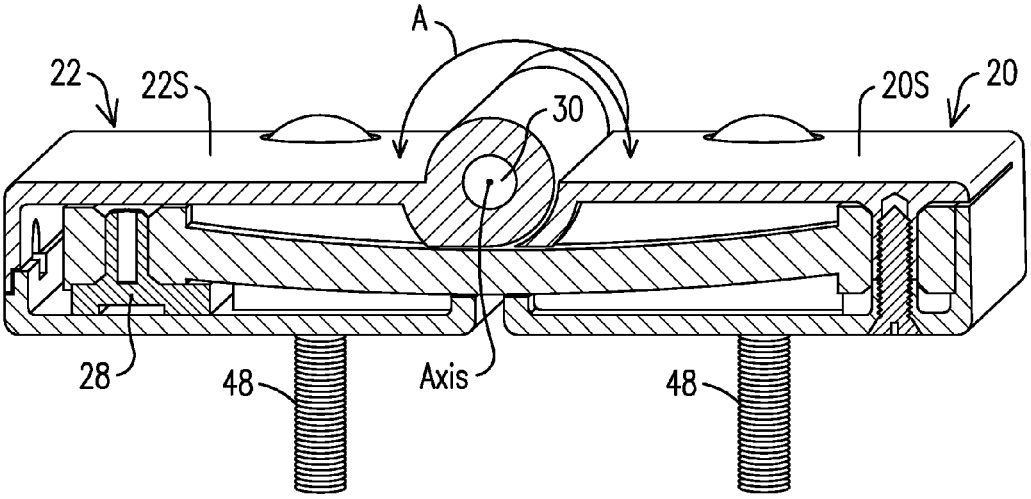
FIG. 4B is a sectional view of the hinge of FIG. 1 also taken through the Axis and along one elastomeric member to provide a side view of the elastomeric member in a gate closed position as shown in FIG. 1 relative to the gate open position shown in FIG. 4A.

The hinge 10 includes the one or more elastomeric members attached thereto so that each, when stretched beyond a first length, develops a closing force that urges the elastomeric member to contract to the first length. A suitable elastomeric member could be in any of a variety of shapes (e.g., a sheet of rubber having a rectangular shape or one or more elongate bands of rubber, each in the form of a flat strip as shown in the figures). FIGS. 4A and 4B illustrate an application of the hinge 10 in which one in a pair of flat elastomeric strips or members 62, 64 move the gate from an open position (e.g., A=90°), such as shown in the view of FIG. 4A, to a closed position (e.g., A=180°), such as shown the view of FIG. 4B. However, in other applications or in other embodiments of the hinge 10, the one or more elastomeric members may move the gate from a closed position to an open position, and the operating range of the hinge angle displacement may be greater or less than 90°. Generally, elastomeric members placed in the hinge 10 function to develop a rotating force about the pintle 30 which changes, e.g., decreases, the hinge angle, A. During operations according to the illustrated embodiments, the hinge angle may typically range from up to about 180 degrees down to about 90 degrees. During operations according to other embodiments, the hinge angle may vary from zero to 360°.

Figure 5A:
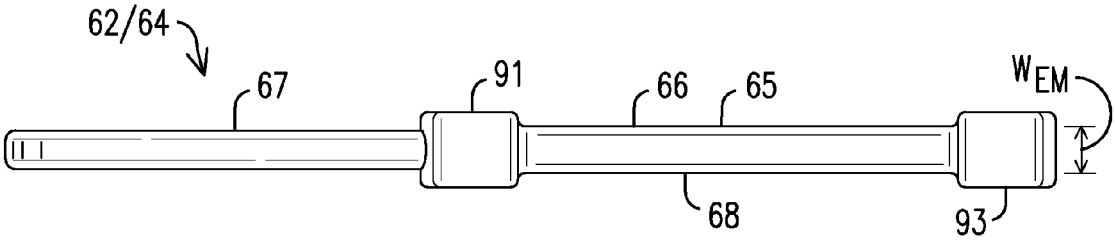
FIG. 5A provides another side view of an elastomeric member suitable for incorporation into the hinge of FIG. 1.
Figure 5B:
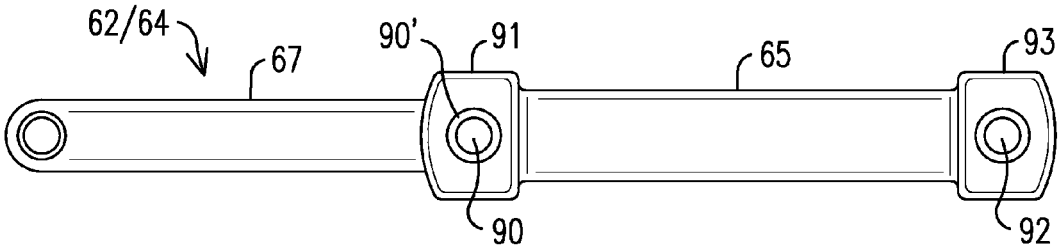
FIG. 5B is a plan view of the elastomeric member shown in FIG. 5A.

The hinge 10 includes a pair of elastomeric members 62, 64 each having an operative segment 65 and a pull segment 67 extending away from the operative segment. See FIG. 5. The pull segment 67, optionally provided for installation of the operative segment 65 under tension, may be used during manual assembly of the hinge 10 during manufacture, or for field installation of the operative segment 65 under tension, or for replacement of elastomeric members 62, 64. The operative segment 65 is the portion of the elastomeric member which develops the closing force. As the gate is opened, a first force is applied to rotate one leaf toward the other leaf. This decreases the hinge angle, A, from about 180°, as shown in FIG. 4B, to about 90°, as shown in FIG. 4A.

With this rotational movement each elastomeric member stretches to develop a counter force, i.e., the closing force, which increases as the angle A decreases. When the first force is reduced or removed, the prevailing counter force can urge rotational movement of the one leaf, in a direction away from the other leaf, to increase the angle, A. This enables the hinge leaves 20, 22 to resume the same hinge angle which normally exists when the door or gate is fully closed. To reliably effect this full movement, the elastomeric members may be pre-tensioned. As more fully described below, the closing force developed on each operative segment 65 may be modified by varying a tension setting with the adjustment module 28. The elastomeric members 62, 64 each have first and second opposing major side surfaces 66, 68. Each of the members is characterized, along the majority of the length of the operative segment 65, by a width, $W_{EM}$, measurable between the surfaces 66, 68. See FIG. 5A. The width, $W_{EM}$, varies based on the extent to which the member is pre-tensioned at the time of installation, and the extent to which the member is stretched, during hinge operation, to develop a counter force, as the hinge angle is reduced. The untensioned width, $W_U$, of an elastomeric member 62, 64 is the maximum width of the member along the majority of the operative segment. When the member is pre-tensioned, the maximum pre-tensioned width during operation of the hinge 10 is $W_{PT}$. As each member 62, 64 is stretched, the width, $W_{EM}$, decreases relative to $W_U$ or $W_{PT}$.

The elastomeric members 62, 64 are each fastened between the hinge leaf 20 and one of the cover plates 24, and between the hinge leaf 22 and the other one of the cover plates 26. As one leaf 20 or 22 is rotated with respect to the other leaf, in a first direction of rotation about the hinge pintle 30, the operative segment 65 of each elastomeric member 62, 64 is stretched to develop a closing force that can urge the leaf which has rotated in the first direction to rotate in a direction of rotation opposite the first direction of rotation. During the process of being stretched to a greater length, or returning to an original length, the width $W_{EM}$ along the operative segment 65 varies.

Figure 3A:
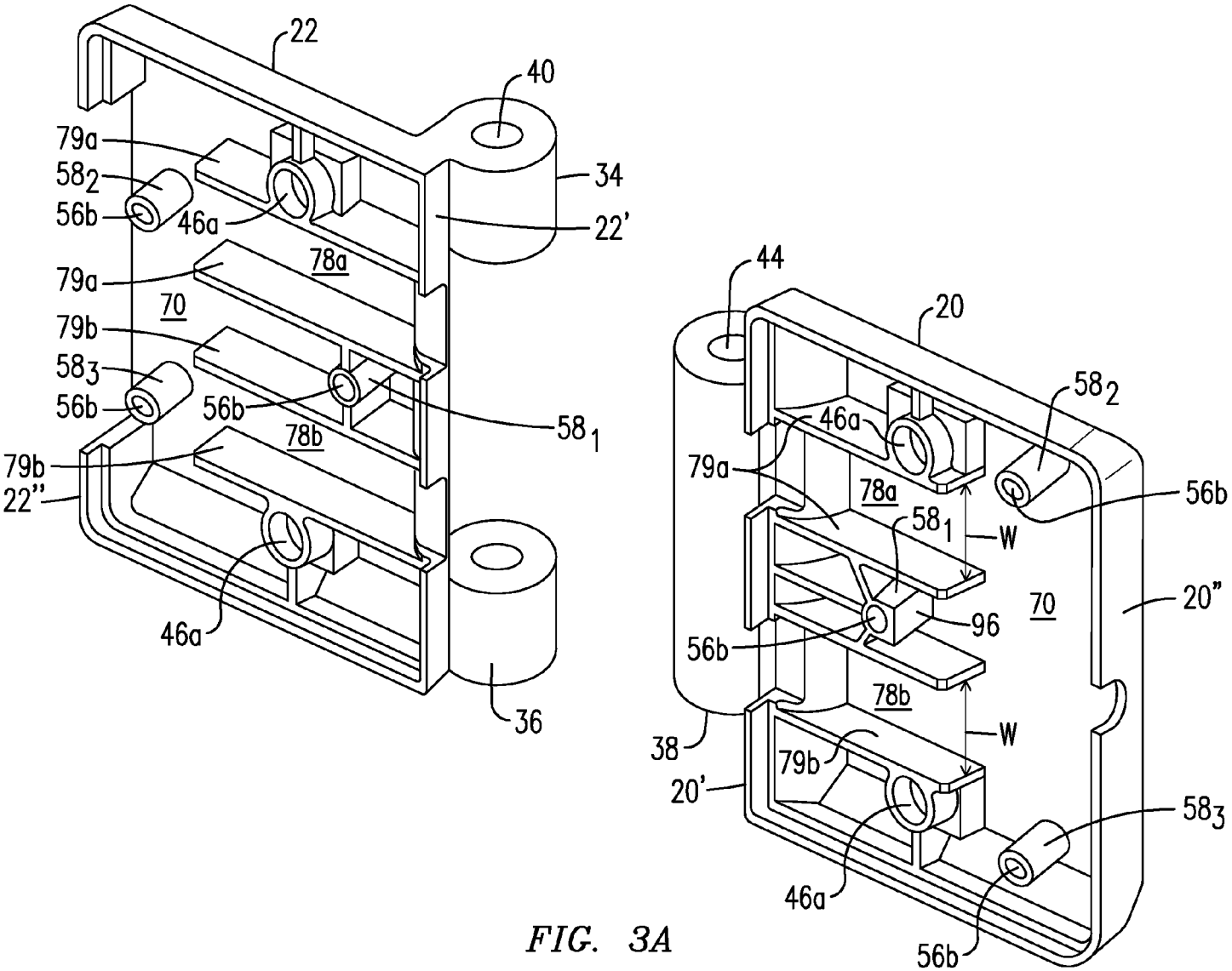
FIG. 3A is a rear view of the hinge leaves showing channel rails which guide movement of the elastomeric bands.
Figure 3B:
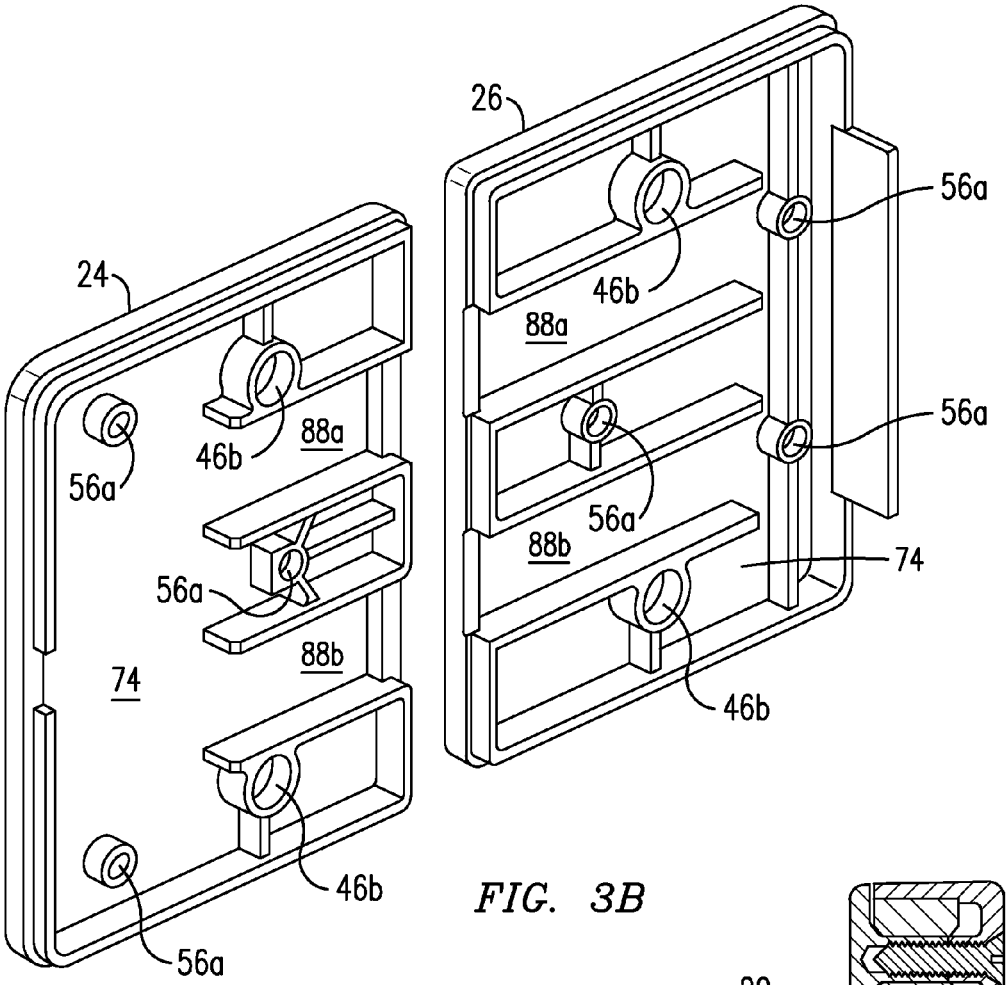
FIG. 3B is a front view of the cover plates showing additional channel rails which also guide movement of the elastomeric bands.

When the members in each leaf and cover plate pair (i.e., pair 20, 24 and pair 22, 26) are attached to one another with fasteners 54 that press the leaf and cover plate against one another, an inside major surface 70 of each leaf 20 or 22 faces an inside major surface 74 of a corresponding cover plate 24, 26. With reference to FIG. 3A, two channels 78*a* and 78*b* are formed along the inside major surfaces 70 of the hinge leaves 20, 22. The channels 78*a*, 78*b* are of suitable minimum width, W, to each receive one of the elastomeric members 62, 64 and are at least of a depth, $D_1$, which enables the elastomeric member to be at least partially recessed therein. Each channel 78*a* and 78*b* is partly defined by pairs of spaced-apart rails 79*a* or pairs of spaced-apart rails 79*b* formed along the inside major surfaces 70 of the hinge leaves 20, 22. Similarly, with reference to FIG. 3B, two channels 88*a* and 88*b* are formed along the inside major surface 74 of each cover plate. The channels 88*a* and 88*b* are of suitable minimum width, W, to each receive one of the elastomeric members 62, 64 and are at least of a depth, $D_2$, which enables the elastomeric member to be at least partially recessed therein. Each channel 88*a* and 88*b* is partly defined by pairs of spaced-apart rails 78*c* or pairs of spaced-apart rails 78*d* formed along the inside major surfaces 74 of the cover plates 24, 26.

The depths $D_1$ and $D_2$ of the channels 78 and 88 are sufficient that when the leaf and cover plate pairs 20, 24 and 22, 26 are assembled, with the elastomeric members 62, 64 placed in the channels 78 and 88, and pressed together with the fasteners 54, the contacting edges of the major surfaces 70 and 74 (e.g., along the first and second inner edges 20', 22') contact one another while not posing significant interference with movement of the operative segments 65 of the elastomeric members. That is, with the elastomeric members sandwiched between the leaf and cover plate pairs, neither the surfaces 70 and 74 nor any other surfaces unduly constrain, i.e., bind movement of, the operative segments 65. Rather, when the leaf and cover plate pairs 20, 24 and 22, 26 are assembled, mating pairs of channels 78*a*, 88*a* and 78*b*, 88*b* form larger channels of sufficient size that portions of the channels adjacent the hinge pintle allow unimpeded movement of the elastomeric members as tension diminishes, i.e., without binding of the elastomeric members.

In the illustrated embodiment the channel widths and the resulting channel depths (e.g., the combination of depths $D_1$ and $D_2$) are sufficient in the mated pairs of channels 78 and 88 that stretching or contracting of the elastomeric members 62, 64 occurs with little or no resistance and smooth operation of the hinge 10 is not impeded. In other embodiments, if portions of the leaves and cover plates do interfere with movement of the operative segments 65, then stretching and contracting of the members 62, 64 along the channels 78 and 88 could be unduly constrained. However, even when there is some interference with movement of the operative segments 65, embodiments of the invention nonetheless enable creation of a net hinge counter force with the elastomeric members. The net counterforce urges rotation of at least one leaf 20, 22, thereby increasing the hinge angle, A, and returning the gate 16 to a closed position.

For the illustrated embodiment, each elastomeric member 62, 64 includes a pair of spaced-apart nodal points 90, 92 which approximate a length of the associated operative segment 65. An end portion 91 of each elastomeric member 62, 64 surrounding a nodal point 90 may have a larger width than the width $W_{EM}$ along the adjoining operative segment 65. Similarly, an end portion 93 of each elastomeric member 62, 64 surrounding a nodal point 92 may have a larger width than the width $W_{EM}$ along the adjoining operative segment 65. In the assembled hinge 10, the end portions 91 surrounding the nodal points 90 are positioned between the hinge leaf 22 and the cover plate 26 and are in the shapes of blocks; and the end portions 93 surrounding the nodal points 92 are positioned between the hinge leaf 20 the cover plate 24 and are also in the shapes of blocks.

Having the pair of hinge leaves 20, 22 coupled together with the pinion 30, each nodal point 90 is fixed about a position $P_1$ near an edge 20" opposite the edge 20' of the leaf 20; and each nodal point 92 is fixed about at a position $P_2$ near an edge 22" opposite the edge 22' of the leaf 22. Fixation of the nodal points 90, 92 at the positions $P_1$, $P_2$ secures the majority of each operative segment 65 of an elastomeric member 62, 64 between a pair of spaced-apart positions $P_1$, $P_2$ in one of the channels 78 or 88. To effect positioning of the nodal points 90, 92 within the channels for operation of the hinge 10, apertures 90' are formed through the elastomeric member and about each of the nodal points 90, and apertures 92' are formed through and about each of the nodal points 92. In the illustrated embodiment, each aperture 90', 92' is a circular opening of sufficient diameter to be placed about a component, such as a cylindrically shaped boss, for mounting of the operative segments 65 with a snug fit. Mounting with a boss extending through each of the apertures 90' provides secure positioning of the operative segments 65 on the bosses $58_2$ and $58_3$ of the hinge leaf 22. More generally, the exterior surfaces of the bosses on which the operative segments 65 are mounted may be of arbitrary shape, and the apertures 90' and 92' may be sized and shaped to matingly receive the bosses therein.

To effect secure positioning of the nodal points 92, the bosses $58_2$ and $58_3$ of the hinge leaf 20 are positioned within the slots 29*s* of the tension adjustment module 28 when the module is installed between the leaf 20 and the cover plate 24. The module 28 includes a pair of spaced-apart module bosses 94 positioned between the flanges 29 and which extend outward from the front side 28*f*. When the module 28 is mounted on the bosses $58_2$ and $58_3$ of the hinge leaf 20, the module bosses 94 face the hinge leaf 20 so that portions 93 of the elastomeric members surrounding each of the nodal points 92 are positioned between the module 28 and the hinge leaf 20. Also, with the module 28 mounted on the bosses $58_2$ and $58_3$, and the hinge leaf 20 brought against the cover plate 24 for assembly of the hinge 10, the module bosses 94 are aligned for the apertures 92' to be passed over the bosses 94 while the apertures 90' are positioned over the bosses $58_2$ and $58_3$ on the hinge leaf 22. Thus the bosses $58_2$ and $58_3$ are inserted within the apertures 90'. This results in positioning of the operative segments 65 for sliding movement within the channels as the hinge angle, A, is varied.

The partial views of FIG. 6 illustrate the operative segments 65 mounted on the tension adjustment module 28 by having the apertures 92' placed over the spaced-apart module bosses 94.

Figure 7A:
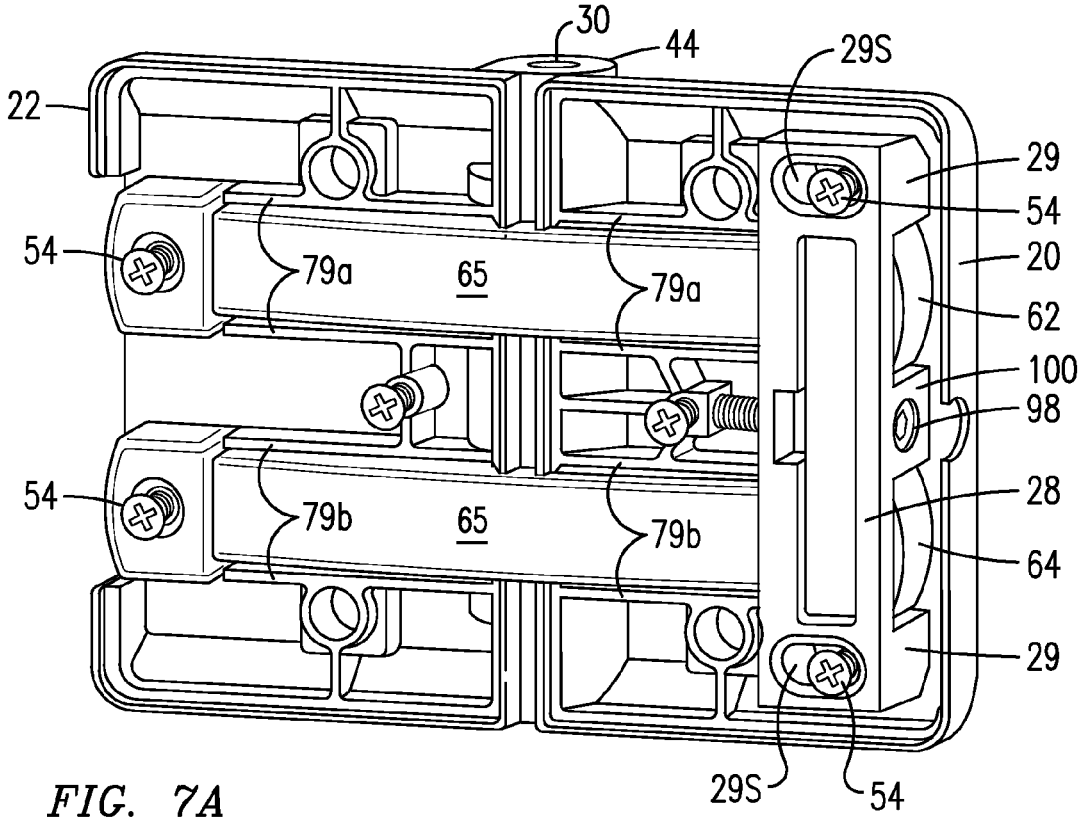
FIGS. 7A and 7B are interior perspective views of the hinge shown in FIG. 1, illustrating horizontal displacement of the tension adjustment module between two setting positions to vary the pretension setting of operative segments of the elastomeric members.
Figure 7B:
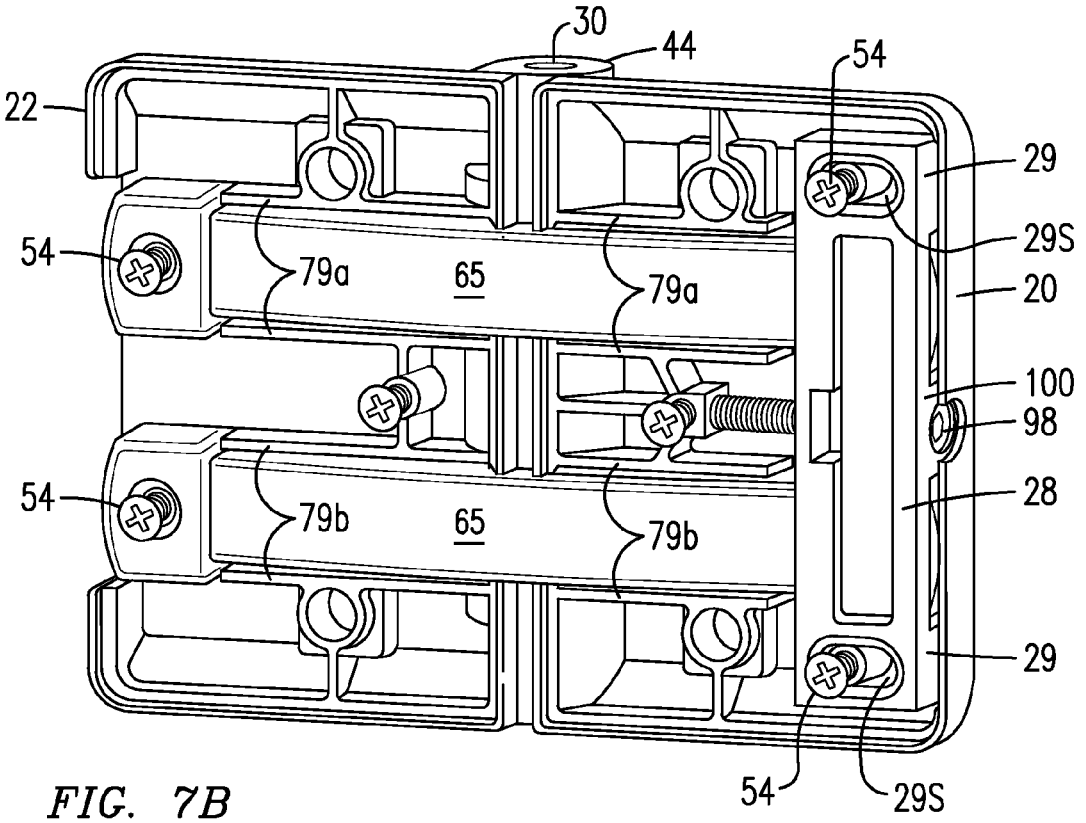

With further reference to FIG. 3A, the exterior of the boss $58_1$ formed on the hinge leaf 20 includes a flat surface facing the outer leaf edge 20" which serves as a stationary stop 96. Displacement of a threaded rod 98 secured to the module 28 imposes a force against the stop 96 to displace the module 28 in the direction along which the slots 29*s* extend by moving the slots 29*s* along the bosses $58_2$ and $58_3$. See FIG. 7A which illustrates the module 28 and associated slots 29*s* in a first position, relatively close to the stop 96, and FIG. 7B which illustrates the module 28 and associated slots 29*s* after being displaced along the bosses $58_2$, $58_3$ to a second position which is relatively far from the stop 96.

Figure 8A:
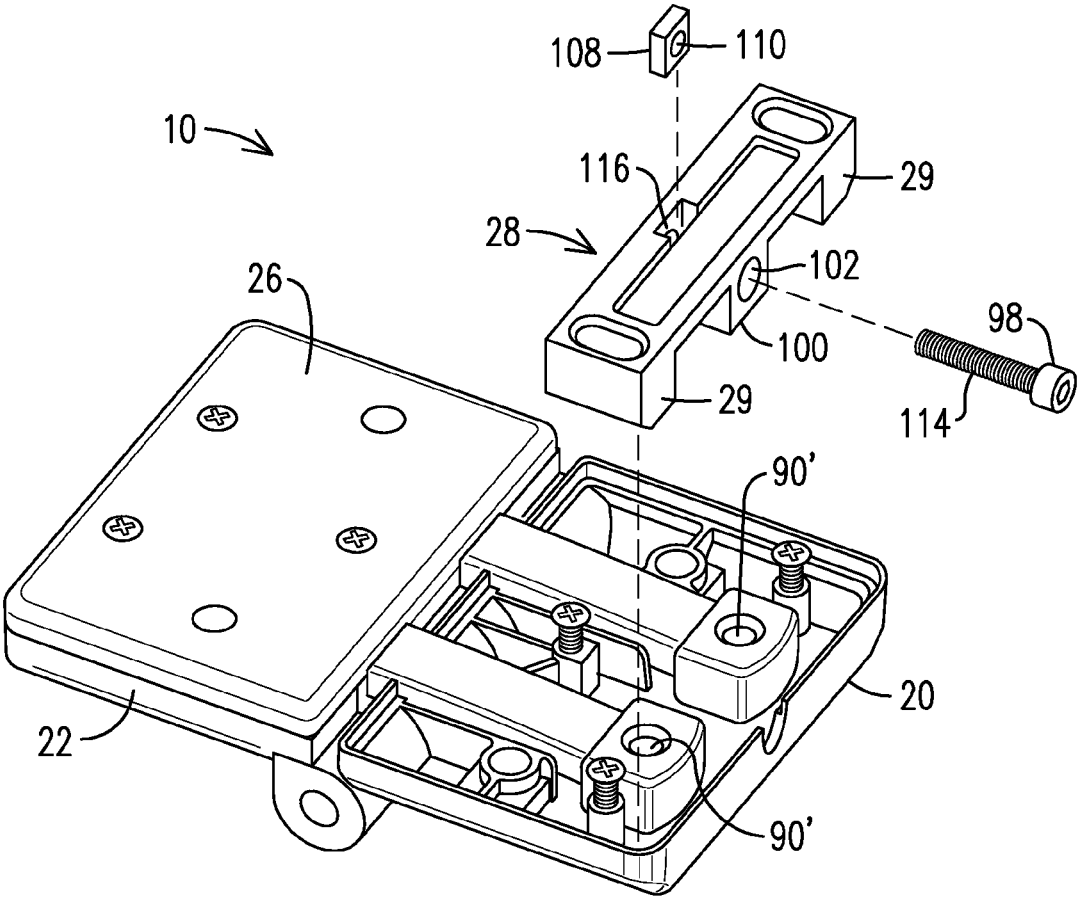
FIG. 8A is a partial exploded view of the hinge of FIG. 1 showing a housing flange for receiving a threaded rod to be rotatably secured within a threaded aperture body in the tension adjustment module.
Figure 8B:
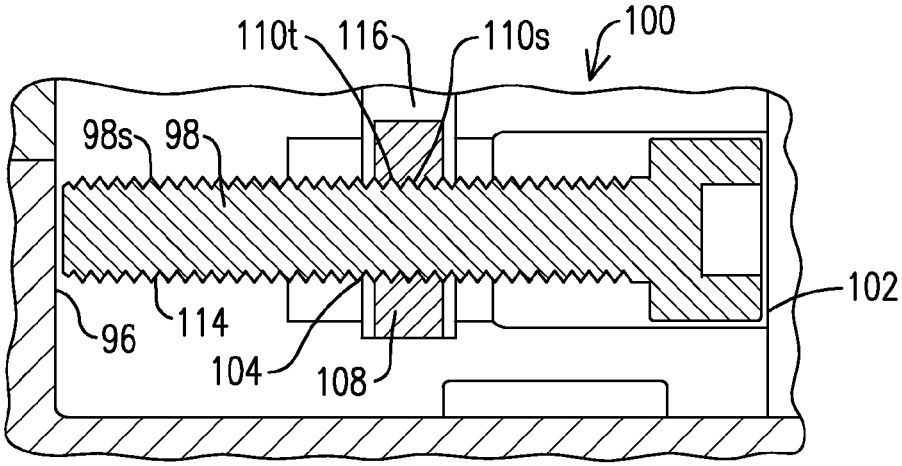
FIG. 8B is a partial view in cross section of the housing flange shown in FIG. 8A taken through the threaded rod.

Displacements between the illustrated positions can stretch or contract the operative segments 65 to adjust the magnitude of the hinge closing force created when the hinge angle A is modified. To effect such displacements, the module 28 further includes a housing flange 100 positioned between the two flanges 29 along the major axis of the module, and extending outward from the front side 28*f* of the module. The partial exploded view of the hinge 10 shown in FIG. 8A illustrates the embodiment where the housing flange 100 is a hollow body, integrally formed as part of the module 28, by which the threaded rod 98 is rotatably coupled to a threaded receiving body in the module 28. Opposing ends of the housing have first and second openings 102, 104. When the module 28 is installed, the end of the housing flange 100 having the first opening 102 faces the edge 20" of the leaf 20 and the end of the housing having the second opening faces the flat surface 96 of the boss $58_1$. The threaded rod 98 is rotatably secured along a surface 98*s* of the rod in a receiving body such as the illustrated square nut 108 having an aperture 110 formed therein. The aperture 110 is bound by a surface 110*s* having threads 110*t* formed thereon. The surfaces 98*s* and 110*s* are complementary, i.e., one fitting within the other. FIG. 8B is a partial view in cross section of the housing flange 100 taken through the threaded rod 98 and the nut 108. Threads 110*t* on the surface 110*s* of the nut 108 matingly engage threads 114 on the surface 98*s* of the rod 98 for receipt and rotational movement of the rod 98 into and through the nut 108. This rotational coupling allows movement of the rod to extend the rod through either opening 102 depending on whether threads 114 of the rod 98 are rotated in a clockwise direction or in a counter clockwise direction. With the module formed of molded plastic, a surface 116 formed in the shape of a slot in the plastic receives the nut 108 and secures it in place. Although one exemplary arrangement for adjusting tension of the operative segments 65 is described, numerous other arrangements for accomplishing similar functions will be apparent to those skilled in the art.

Generally, the adjustment can be effected with first and second complementary surfaces such that one surface fits within the other, e.g., with each of the surfaces including a threaded pattern complementary to the threaded pattern formed on the other surface. Thus the threaded patterns matingly engage one another so that with rotation of one surface there is relative displacement of that surface along a first direction with respect to the other surface and the other threaded pattern. In lieu of the illustrated threaded rod 98, a barrel-shaped hollow body may have a threaded aperture extending there through. The barrel shaped body may have a hexagonal exterior shape like that of a nut. In still other embodiments, instead of providing a discrete barrel shaped hollow body, a threaded aperture may be formed in a solid portion of the module 28 (e.g., integrally formed in a portion of an injection molded or cast body). With insertion of a threaded rod within the barrel aperture (or within the threaded aperture may be formed in a solid portion of the module 28) for mating engagement of two sets of threads, the barrel-shaped hollow body (or the solid portion of the module 28) can be displaced to impose a force against the stop 96 and displace the module 28 in the direction along which the slots 29*s* extend.

Two spaced-apart flanges 29 are formed along the major axis of the module, extending outward from the front side 28*f*. Each flange 29 includes a horizontal slot 29*s*. That is, when the hinge is installed on the fence post 14, above the horizontal ground plane, the slots 29*s* each extend in a direction parallel to the horizontal ground plane over which the gate 16 and post 14 are installed.

With the tension adjustment module 28 interposed between the hinge leaf 20 and cover plate 24, the slots 29*s* formed in the flanges 29 are aligned for simultaneous insertion of the bosses $\mathbf{58}_2$ and $\mathbf{58}_3$ therein. This arrangement effects securement of the module 28 with fasteners 54 while the module 28 retains a degree of freedom to provide movement in the afore-described horizontal direction. The examples used to describe fabrication of the invention describe the invention in a simple form while it will be apparent to persons skilled in the art that numerous commercial embodiments will employ additional features that enhance performance. Numerous additional modifications will be apparent to those skilled in the art. Accordingly the scope of the invention is only limited by the claims which now follow.

The claimed invention is:

1. A hinge for supporting a gate or door along a fence or wall, comprising:

first and second hinge leaves, one of the leaves having fastening apertures for attachment along a surface of a gate or door, and the other of the leaves having fastening apertures for attachment along a fence, post or wall surface;

first and second bearing sleeves attached along an edge of the first leaf in spaced-apart relation to one another;

a third bearing sleeve, having a pintle aperture, attached along an edge of the second leaf so that, when the edge of the second leaf is positioned along the edge of the first leaf, the third bearing sleeve can be positioned between the first and second bearing sleeves, the first and second bearing sleeves each including a pintle aperture that can be aligned with the aperture of the third bearing sleeve when the third bearing sleeve is positioned between the first and second bearing sleeves;

a hinge pintle sized to extend into each of the pintle apertures for mating engagement with the first, second and third bearing sleeves and thereby connect the first and second hinge leaves to one another for rotation of one of the leaves about the hinge pintle and to support a hinge load;

first and second cover plates, the first of the cover plates having fastening apertures for attachment to the first leaf and the second of the cover plates having fastening apertures for attachment to the second leaf; and an elastomeric member having a first end portion fastened between the first hinge leaf and the first of the cover plates, and having a second end portion fastened between the second hinge leaf and the second of the cover plates wherein:

as one leaf is rotated in a first direction of rotation about the hinge pintle, from a first angle to a larger angle, the member is stretched beyond a first length to develop a force urging the member to resume the first length, which force urges said one leaf to rotate in a direction of rotation opposite the first direction of rotation.

2. The hinge of claim 1 wherein the elastomeric member is an elongate body having a relatively large length to width ratio with a length extending between first and second end portions and from the first hinge leaf to the second hinge leaf so that when one of the hinge leaves is rotated with respect to the other hinge leaf to increase tension in the elastomeric member, the length of the elastomeric member increases.

3. A method of forming the hinge of claim 1 comprising the step of forming a channel along at least one hinge leaf and one cover plate into which the elastomeric member fits, the channel allowing for movement of the elastomeric member when sandwiched between the at least one hinge leaf and one cover plate.

4. The method of claim 3 wherein the channel adjoins at least one of the bearing sleeves, and the channel is formed of sufficient size that portions of the channel adjoining said one of the bearing sleeves are of sufficient size to allow for movement of the elastomeric member as tension diminishes without binding of the elastomeric member.

5. A method for stretching an elastomeric member having first and second opposing end portions to adjust of an opening or closing force in a hinge comprising first and second hinge plates, a bar mounted along a slot for sliding engagement along the second hinge plate, the slot having a length which limits the extent to which the bar moves along the second hinge plate, the method comprising:

affixing the first of the end portions of the elastomeric member to the first hinge plate and connecting the second of the end portions of the elastomeric member for movement with the bar so that, when one of the hinge plates is rotated with respect to the other hinge plate, tension in the elastomeric member changes; and sliding the bar along the slot to cause sliding movement of the bar along the second hinge plate, the slot limiting the extent of sliding movement by the bar, sliding movement of the bar causing movement of the second of the end portions of the elastomeric member relative to the hinge plate to modify tension present in the elastomeric member when said one of the hinge plates is rotated with respect to the other hinge plate.

6. The method of claim 5 wherein the step of displacing the bar includes turning of a threaded rod within a threaded aperture to displace the bar along the second hinge plate.

7. A module for adjusting tension in an elastomeric member used to provide a force in a hinge comprising a pair of hinge plates, comprising:

a bar, having a slot formed therein, coupled to a component on a first one of the hinge plates to permit selective movement of the slot along the component to permit movement of the bar, with respect to the first of the hinge plates, along a path constrained by the bar slot; and an elastomeric member for providing a force when the hinge plates are rotated, the elastomeric member having first and second opposing end portions, the first of the end portions connected to the bar for displacement therewith so that when the second of the end portions is attached to a second one of the hinge plates, tension of the elastomeric member varies as the bar is moved with respect to the first of the hinge plates.

8. The module of claim 7 wherein the bar includes an attachment component to secure the first of the elastomeric member end portions connected to the bar, the module further including a threaded member rotationally coupled to apply a force to displace the bar relative to said one of the hinge plates and thereby create or remove tension in the elastomeric member.

9. A hinge and adjustment module combination for supporting a gate or door and for adjusting tension that provides a force to urge movement in the hinge, comprising:

first and second hinge plates;

first and second bearing sleeves attached along an edge of the first plate in spaced-apart relation to one another;

a third bearing sleeve attached along an edge of the second plate so that the third bearing sleeve can be positioned between the first and second bearing sleeves, the first, second and third bearing sleeves each including an aperture that can be co-aligned with the other apertures when the third bearing sleeve is positioned between the first and second bearing sleeves;

a hinge pintle sized to extend into each of the apertures to connect the first and second hinge plates to one another for rotation of one of the plates about the hinge pintle;

an elastomeric member, having first and second opposing end portions, which member, when stretched beyond a first length, develops a force urging the member to resume the first length, the first end portion attached for movement with motion of the first hinge plate; and a bar having at least one slot formed therein and coupled to a component on the second hinge plates to permit movement of the bar with respect to the second hinge plate, the bar including a second component configured to secure the second end portion of the elastomeric member to the bar, wherein:

as one plate is rotated in a first direction of rotation about the hinge pintle, from a first angle to a larger angle, the elastomeric member is stretched beyond the first length to develop a force urging the member to resume the first length, which force urges said one plate to rotate in a direction of rotation opposite the first direction of rotation.

10. A mechanism for adjusting the force applied by an elastomeric member to a movable hinge section, comprising:

an adjustment element including a first surface along which a first threaded pattern is formed;

a tension adjustment body having a second surface along which a second threaded pattern is formed, the first and second surfaces being complementary so that one fits within the other, and the first and second threaded patterns being complementary to each matingly engage the other so that the adjustment element is displaced along a first direction as the first surface and the first threaded pattern are rotated with respect to the second surface and the second threaded pattern;

an elastomeric member having first and second opposing end portions;

a hinge comprising first and second hinge sections connectable to one another for rotation about an axis, (i) the first hinge section including a first component to restrict movement of the first end portion with respect to the first hinge section when the elastomeric member is tensioned, and (ii) the second hinge section including one or more features by which the tension adjustment body is coupled to the hinge and coupled to restrict movement of the tension adjustment body along the first direction relative to one of the hinge sections, the hinge section including a stop surface positioned to receive a force by a rotation of the adjustment element which displaces the first surface with respect to the second surface, wherein the tension adjustment body includes a third component to secure the second end portion of the elastomeric member and restrict movement of the second end portion relative to the tension adjustment body so that, with the hinge sections connected to one another and the elastomeric member tensioned:

(i) when one of the hinge sections is rotated with respect to the other hinge section, tension of the elastomeric member changes, and (ii) when movement of the first end portion and the second end portion of the elastomeric member is restricted, tension in the elastomeric member is adjusted by a rotation of the adjustment element with respect to the aperture.

11. The mechanism of claim 10 wherein the second surface defines an opening into which the first surface fits.

12. The mechanism of claim 10 wherein one of the first and second surfaces defines a threaded aperture into which the other surface fits.

13. The mechanism of claim 12 wherein the tension adjustment body comprises a nut and the second surface defines a threaded aperture of the nut.

14. The mechanism of claim 10 wherein the adjustment element is an adjustment rod, the first surface of the adjustment element is an exterior portion of the rod with the threaded pattern formed along the exterior portion, and the second surface of the tension adjustment body is a surface formed as a slot along which an aperture is positioned, into which aperture the exterior portion of the rod fits, with the second threaded pattern extending along the aperture to matingly engage the first threaded pattern as the rod exterior portion is rotated and inserted within the aperture.

15. The mechanism of claim 14 wherein the tension adjustment body comprises a nut positioned in the slot through which the aperture extends and into which the exterior portion of the rod fits, with the second threaded pattern formed along the aperture to engage the first threaded pattern.

16. The mechanism of claim 10 wherein the elastomeric member is an elongate body having a relatively large length to width ratio with the length extending between the first and second end portions and from the first hinge section to the second hinge section so that when one of the hinge sections is rotated with respect to the other hinge section to increase tension in the elastomeric member, the length of the elastomeric member increases.

17. The mechanism of claim 10 wherein the stop surface is positioned on the second hinge section.

18. The mechanism of claim 10 wherein the first hinge section both secures the first end portion of the elastomeric member to the first hinge section and restricts movement of the first end portion with respect to the first hinge section when the elastomeric member is tensioned.

19. The mechanism of claim 10 comprising a second elastomeric member also having first and second opposing end portions wherein (i) the first hinge section secures the first end portion of the second elastomeric member to the first hinge section and restricts movement of the first end portion with respect to the first hinge section when the second elastomeric member is tensioned; and (ii) the tension adjustment body secures the second end portion of the second elastomeric member and restricts movement of the second end portion of the second elastomeric member relative to the tension adjustment body.

20. The mechanism of claim 10 wherein restricted movement of the tension adjustment body is effected with a slot formed in the tension adjustment body which permits movement of the tension adjustment body along the first direction relative to the second hinge section.

* * * * *